US008100398B2

(12) United States Patent
Brock

(10) Patent No.: US 8,100,398 B2
(45) Date of Patent: Jan. 24, 2012

(54) PRINTER MEDIA TRANSPORT SYSTEM

(75) Inventor: Kelly A. Brock, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 12/428,017

(22) Filed: Apr. 22, 2009

(65) Prior Publication Data

US 2010/0269859 A1 Oct. 28, 2010

(51) Int. Cl.
*B65H 3/06* (2006.01)

(52) U.S. Cl. ..... 271/109; 15/256.53

(58) Field of Classification Search ..... 271/109; 15/256, 53, 256.53
See application file for complete search history.

(56) References Cited

U.S. PATENT DOCUMENTS

| | | | | |
|---|---|---|---|---|
| 3,848,994 | A | 11/1974 | Fraser | |
| 4,101,215 | A | 7/1978 | Fottner et al. | |
| 4,398,820 | A | 8/1983 | Thayer | |
| 5,130,755 | A | 7/1992 | Ikegawa et al. | |
| 5,616,386 | A | 4/1997 | Okada et al. | |
| 6,042,104 | A * | 3/2000 | Nishikori et al. | 271/121 |
| 6,102,509 | A | 8/2000 | Olson | |
| 6,135,444 | A | 10/2000 | Padget | |
| 6,386,663 | B1 | 5/2002 | Olson | |
| 7,029,005 | B2 | 4/2006 | Brock et al. | |
| 7,062,194 | B2 * | 6/2006 | Yanagida et al. | 399/100 |
| 7,204,483 | B2 | 4/2007 | Mo et al. | |
| 7,255,042 | B2 | 8/2007 | Sasaki | |
| 7,370,857 | B2 | 5/2008 | Otsuki | |
| 7,455,288 | B2 | 11/2008 | Ruhe et al. | |
| 2005/0017433 | A1 | 1/2005 | Otsuki et al. | |
| 2007/0201919 | A1 | 8/2007 | Okazaki | |
| 2007/0231033 | A1 | 10/2007 | Okazaki | |
| 2007/0257424 | A1 | 11/2007 | Okazaki | |
| 2008/0251992 | A1 | 10/2008 | Mo et al. | |

* cited by examiner

*Primary Examiner* — Michael McCullough

(57) ABSTRACT

A printer media transport system includes a pick roller and a cleaner roller. The pick roller has a pick surface configured to rotate and frictionally direct printable media along a feed path, and the cleaner roller is configured to contact the pick roller, rotate as the pick roller rotates, and translate rotation of the cleaner roller to lateral movement of the cleaner roller against the pick surface of the pick roller.

16 Claims, 4 Drawing Sheets

PRINTER MEDIA TRANSPORT SYSTEM

BACKGROUND

A printer may include a print carriage provided with one or more print cartridges, a media input tray configured to maintain a stack of printable media sheets, and a media transport system configured to remove a single sheet of the printable media sheets and direct it into a print zone for printing by the print cartridge(s). Exemplary media transport systems include a pick roller that is biased into contact with a top sheet of the printable media. Rotation of the pick roller causes the pick roller to frictionally pick the top sheet from the stack of media sheets and deliver it into the print zone.

However, the pick roller is subject to contamination by debris, for example during use in dusty/dirty environments. Contaminated pick rollers have the potential to cause undesirable picking failures characterized by the pick roller not picking the topmost sheet or picking more than one sheet.

For these and other reasons, a need exists for the present invention.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments provide an apparatus and a method for low torque scrubbing/cleaning of a pick roller in a media printer. One embodiment provides a cleaner roller that rotates when contacted by the pick roller, and the rotation of the cleaner roller causes side-to-side movement of the cleaner roller relative to a pick surface of the pick roller. The side-to-side movement of the cleaner roller imparts a lateral scrubbing movement of the cleaner roller against the pick roller, which enables the pick roller to remove debris from the pick surface of the pick roller.

This specification describes cylindrical rollers. By convention, each cylindrical roller has a radius defining a radial dimension of the roller and a length that extends in an axial (lateral) direction along the length of the cylindrical roller. In the context of a cylindrical roller, "lateral" and "axial" are used synonymously in this document. Bi-lateral movement of the cleaner roller, or moving the cleaner roller bi-laterally, means to move the cleaner roller back and forth in the axial direction (e.g., repeatedly left and then right as one faces the cylindrical roller).

Figure 1:
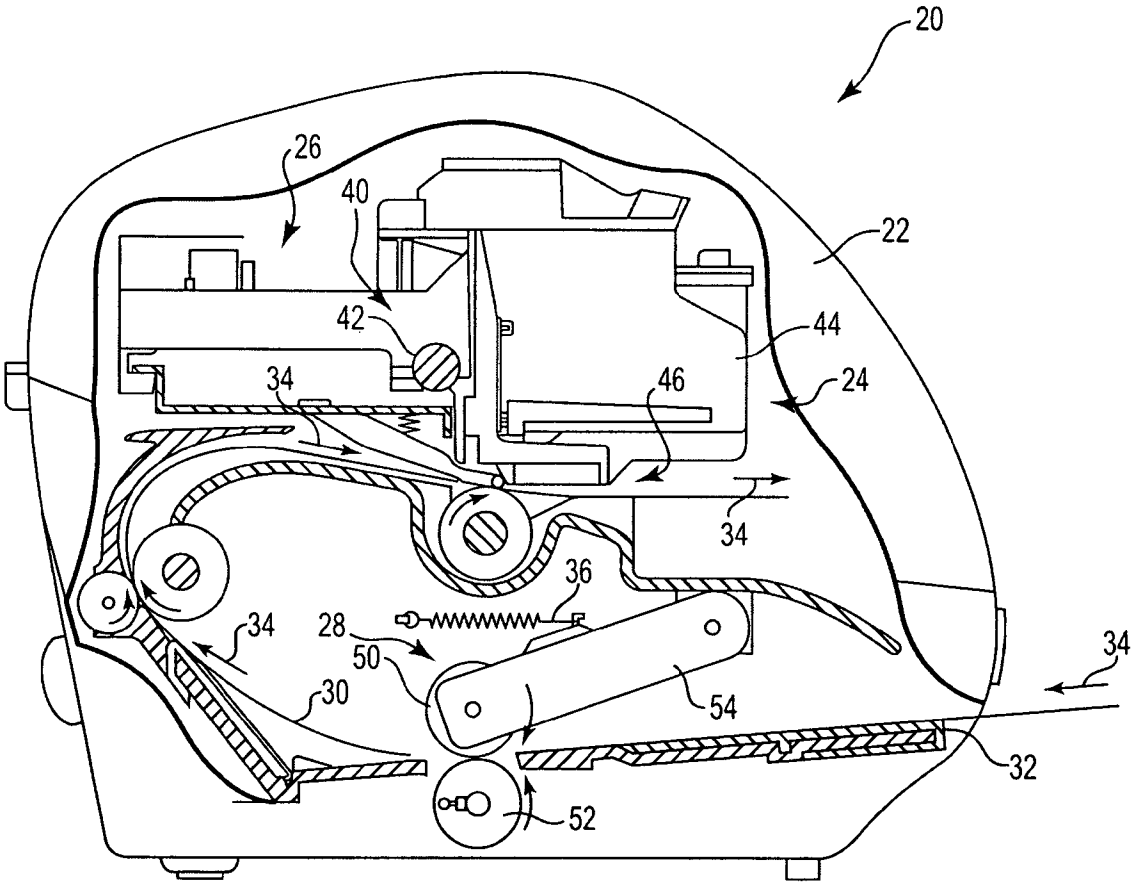
FIG. 1 is a schematic side view of a printer including a pick roller and a cleaner roller according to one embodiment.

FIG. 1 is a schematic side view of a printer 20 according to one embodiment. Printer 20 includes a housing 22 enclosing a print engine 24, a controller 26 communicating with print engine 24, and a printer media transport system 28 configured to direct printable media 30 extracted from an input tray 32 along a feed path 34.

Housing 22 provides a finished enclosure around a chassis that supports the structural elements of printer 20.

In one embodiment, print engine 24 includes a carriage 40 that is driven back and forth along a guide rail 42 that is mounted to the chassis, where carriage 40 includes one or more stalls (occupied), each configured to hold a cartridge 44. In one embodiment, a suitable drive mechanism is employed to move carriage 40. For example, a reversing motor (not shown) may be coupled to carriage 40 through a belt and pulley system (not shown).

In one embodiment, carriage 40 includes two cartridges 44, one cartridge containing color ink for color printing and one cartridge 44 containing black ink for monochrome printing. Typically, cartridges 44 are positioned along feed path 34 such that each sheet of printable media 30 passes under cartridges 44 in a print zone 46. In one embodiment, a bottom of each cartridge 44 is directed to face the media sheet 30 and includes an array of nozzles through which drops of ink are ejected onto media sheet 30.

Controller 26 receives print data from a computer, scanner, digital camera or other image generating device. Controller 26 controls the movement of carriage 40 back and forth across media sheet 30 and advances media sheet 30 along feed path 34. Controller 26 is configured to selectively activate ink ejection from cartridges 44 as carriage 40 moves cartridges 44 across media sheet 30. By combining the movement of carriage 40 across media sheet 30 with the movement of media sheet 30 along feed path 34, controller 26 causes cartridges 44 to eject ink onto media sheet 30 to form the desired print image.

In one embodiment, printer media transport system 28 includes a pick roller 50 configured to rotate and frictionally direct printable media 30 along feed path 34, and a cleaner roller 52 configured to clean pick roller 50 when media 30 is removed from tray 32. With this in mind, media sheet 30 is illustrated in FIG. 1 to describe the flow of media sheet 30 along feed path 34, but it is to be understood that media sheet 30 would typically not be present when pick roller 50 touches cleaner roller 52.

In one embodiment, pick roller 50 is attached to a swing arm 54 that is biased relative to tray 32 by a spring 36. When a stack of media sheets 30 is inserted into tray 32, swing arm 54 moves upward and spring 36 biases pick roller 50 into contact with a topmost sheet 30. Pick roller 50 is driven by a motor (not shown) and rotates, for example, in the clockwise direction shown. In this manner, the desired transport of a single sheet of printable media 30 along feed path 34 is achieved to enable print engine 24 to eject ink from cartridges 44 to form the desired print image. During operation, it is possible that dust and/or debris in the local environment may accumulate on pick roller 50. Contaminated pick rollers have the potential to undesirably fail to pick the topmost sheet off of the tray 32, or pick more than one sheet, both outcomes of which are undesirable.

In one embodiment, when the stack of media sheets 30 is removed from tray 32 pick roller 50 deflects downward into contact with cleaner roller 52. In one embodiment, cleaner roller 52 is configured to be rotated and driven by the rotational motion of pick roller 50, and to move laterally in contact with pick roller 50 to scrub the pick surface of pick roller 50 and remove debris that may have accumulated on pick roller 50. In one embodiment, cleaner roller 52 is configured to rotate and move bi-laterally (e.g., into and out of the plane of the paper relative to FIG. 1) as pick roller 50 rotates.

Figure 2:
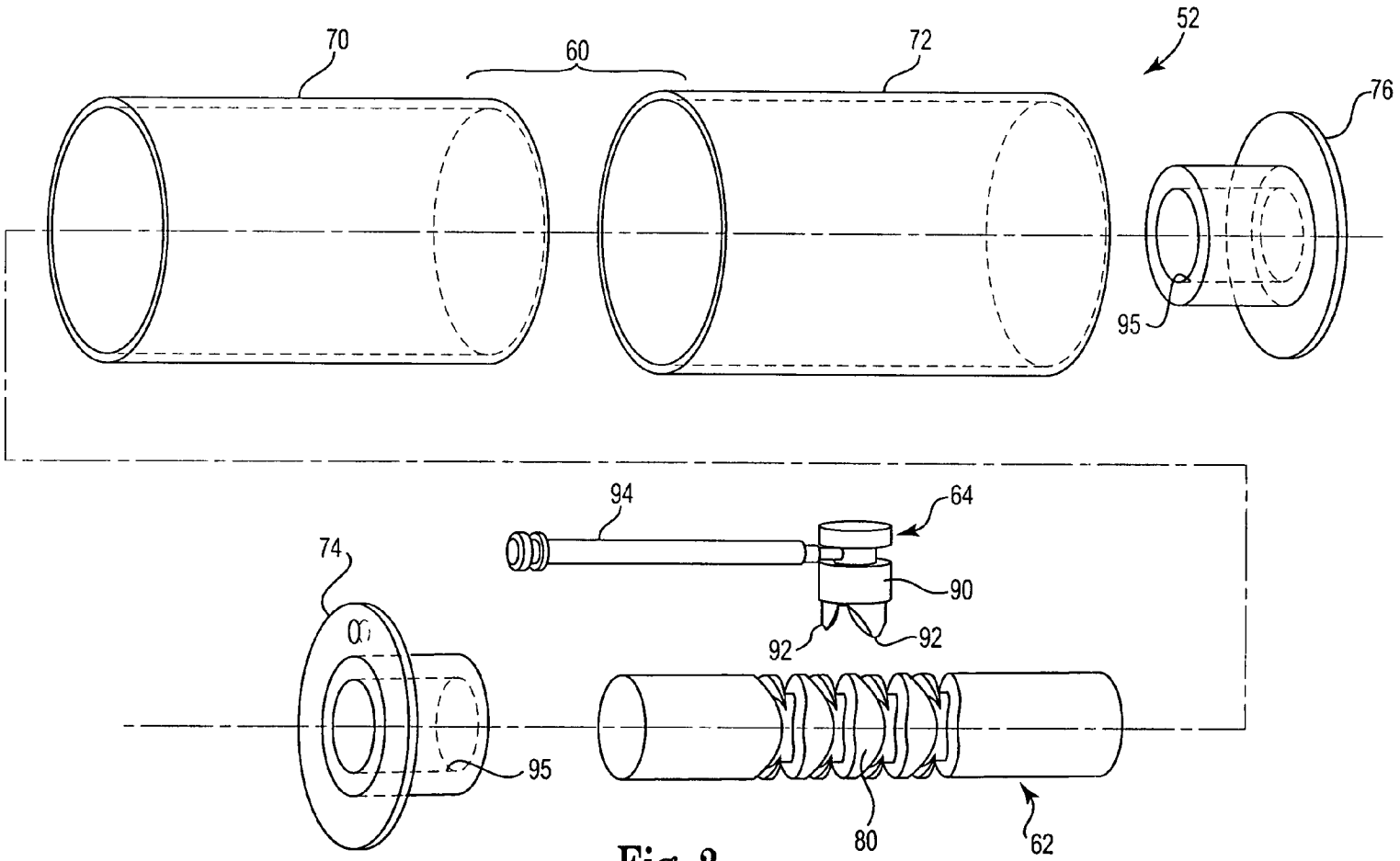
FIG. 2 is an exploded perspective view of the cleaner roller illustrated in FIG. 1 according to one embodiment.

FIG. 2 is an exploded perspective view of one embodiment of cleaner roller 52. In one embodiment, cleaner roller 52 includes a drum 60, an axle 62 disposed within drum 60, and a follower blade 64 coupled to drum 60. In one embodiment, axle 62 is a stationary axle 62 that remains fixed relative to rotation of drum 60. In one embodiment, follower blade 64 is coupled to drum 60 and is configured to engage with stationary axle 62 to impart lateral motion to drum 60 as drum 60 is rotated by pick roller 50 (FIG. 1).

In one embodiment, drum 60 includes a cylindrical shell 70, a cleaning surface 72 configured to be disposed over shell 70, and opposing ends 74, 76 that couple to opposite ends of shell 70 and receive stationary axle 62.

Shell 70 is generally a thin walled cylindrical structure formed of a suitable supporting material. In one embodiment, shell 70 is molded from plastic into an annular form and is configured to receive cleaning surface 72 on its exterior surface.

In one embodiment, cleaning surface 72 is provided as a cylindrical sleeve that is friction-fit over shell 70. In one embodiment, cleaning surface 72 is formed from an extruded foam material and is disposed as a sleeve over shell 70. In one embodiment, cleaning surface 72 is formed as a rubber or polymer member and the outer cleaning surface 72 is textured or otherwise configured to gently scrub against pick roller 50 (FIG. 1) to remove debris from pick roller 50.

In one exemplary embodiment, pick roller 50 is provided with a pick surface having a durometer of between 80-90 Shore A, and cleaning surface 72 is configured to be softer than the pick surface of pick roller 50 and have a durometer of less than 80 Shore A.

In one embodiment, opposing ends 74, 76 are sized to be fit into shell 70 and include a journal bearing 95 configured to receive stationary axle 62. When assembled, stationary axle 62 projects out of each opposing end 74, 76 and is configured to rotate within journal bearings 95.

Axle 62 is configured to have a length that is longer than drum 60 such that ends of axle 62 extend beyond drum 60. In one embodiment, axle 62 includes a pattern of grooves 80 into which follower blade 64 meshes. The pattern of grooves 80 is configured to provide a flight or transfer pattern of troughs configured to be followed by follower blade 64. When follower blade 64 is engaged with grooves 80, follower blade 64 will move in one direction (e.g., left) before coming to a stop formed by an end of grooves 80, and then reverse course and move in an opposite direction (e.g., right) relative to stationary axle 62. In one embodiment, the pattern of grooves 80 is formed as a helical pattern of bi-lateral reversing grooves such that when drum 60 rotates, blade 64 also rotates and is forced by the pattern of grooves 80 to translate laterally left and/or right relative to stationary axle 62.

In one embodiment, follower blade 64 includes a head portion 90 having feelers 92 and a retention pin 94 that couples head 90 to drum 60. For example, in one embodiment retention pin 94 attached to end 74 of drum 60 and rotates as drum 60 rotates. In this manner, as drum 60 rotates (and end 74 rotates) follower blade 64 likewise rotates. Accordingly, feelers 92 mesh with grooves 80 and cause drum 60 to traverse laterally left/right along stationary axle 62 as drum 60 rotates.

Figure 3:
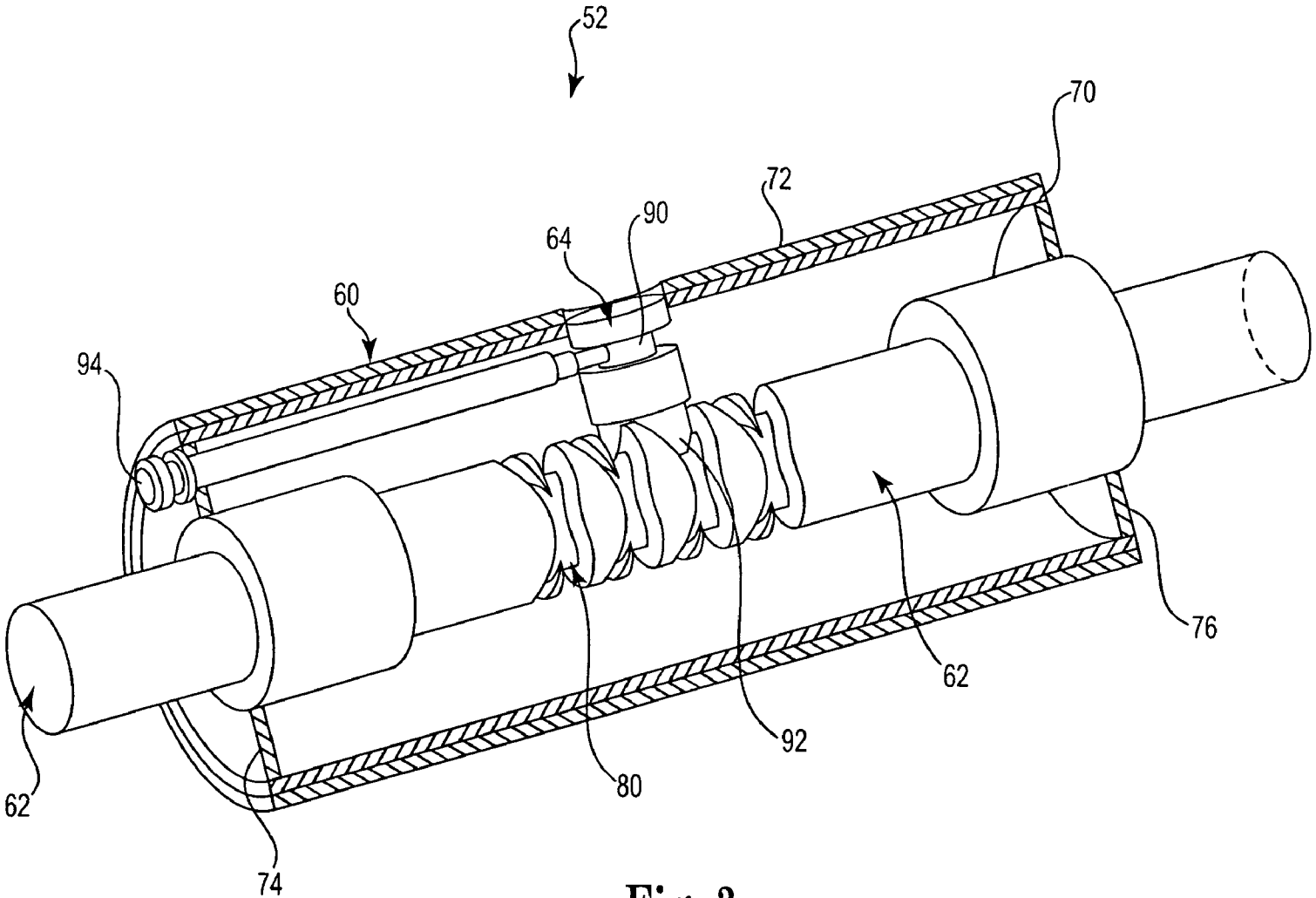
FIG. 3 is a partial sectional view of the cleaner roller as assembled according to one embodiment.
Figure 4:
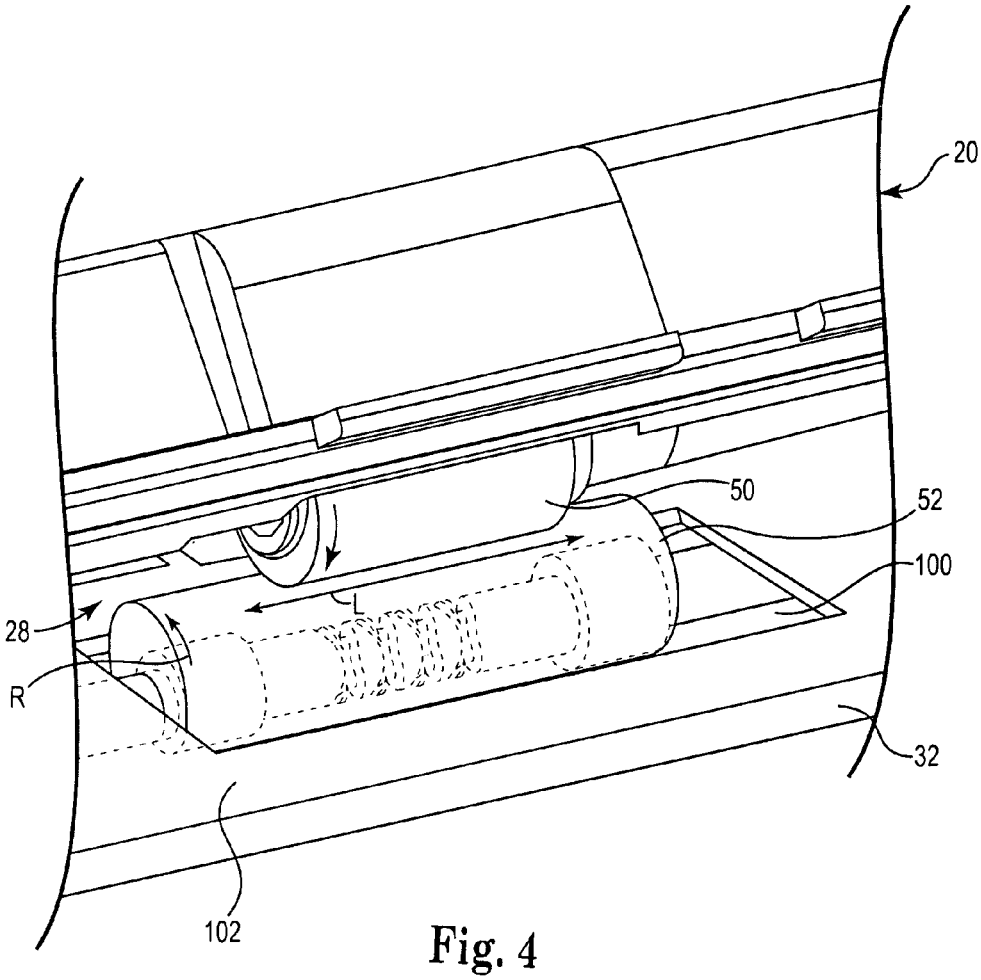
FIG. 4 is a perspective view looking into a front of the printer illustrated in FIG. 1 and showing the cleaner roller in contact with the pick roller according to one embodiment.

FIG. 3 is a partial sectional view of one embodiment of cleaner roller 52 as assembled and FIG. 4 is a perspective view of one embodiment of a cleaner roller 52 cleaning pick roller 50 when viewed looking into a front of the printer 20.

In one embodiment, as illustrated in FIG. 4, cleaner roller 52 is disposed in a window 100 formed in a media support surface 102 of tray 32. Window 100 is sized to provide clearance for cleaner roller 52 to move laterally left and right within window 100 relative to stationary (and rotating) pick roller 50. Follower blade 64 is not visible in FIG. 4 as it is behind axle 62.

In the embodiment of FIG. 4, media 30 (FIG. 1) has been removed from tray 32 and pick roller 50 is biased into contact with cleaner roller 52. In one embodiment, commands from controller 26 (FIG. 1) operate a driver connected to printer 20 that recommends cleaning of pick roller 50. The cleaning method includes rotating pick roller 50, moving cleaner roller 52 through the rotation of pick roller 50, and sliding cleaning roller 52 axially relative to and along pick roller 50. In such a case, pick roller 50 rotates and causes rotation R of cleaner roller 52 and lateral movement L of cleaner roller 52 against pick roller 50. The lateral movement L of cleaner roller 52 scrubs the surface of pick roller 50 to remove debris from pick roller. The debris falls under gravity to a collection area under window 100.

In one embodiment, cleaner roller 52 is wider than pick roller 50. In one embodiment, cleaner roller 52 is wider than pick roller 50 by a dimension N, and cleaner roller 52 moves side-to-side through a lateral stroke distance of approximately N/2.

With reference to FIGS. 2-4, rotation of pick roller 50 causes rotation of drum 60 of cleaner roller 52, and rotation of drum 60 translates to lateral motion of follower blade 64. Since follower blade 64 is coupled to drum 60, lateral motion of follower blade 64 also results in lateral movement of drum 60. In this manner, rotating cleaner roller 52 by rotation of pick roller 50 causes cleaner roller 52 to rotate in the direction R and scrub against pick roller 50 side-to-side with lateral movement L. In one embodiment, feed path 34 (FIG. 1) defines a feed direction for media transport system 28, and rotation of pick roller 50 causes cleaner roller 52 to slide against pick roller 50 in a direction substantially orthogonal to the feed direction.

In one embodiment, as described above, pattern of grooves 80 formed in stationary axle 62 configure cleaner roller 52 to move bi-laterally in an axial direction relative to pick roller 50. For example, in one embodiment, the pattern of grooves 80 is formed as a helical pattern of grooves incorporating a left stop and a right stop. As cleaner roller 52 rotates, the bi-lateral movement of cleaner roller 52 is characterized by blade 64 moving to the right, stopping against the right stop where it is directed to the left until it comes to the left stop, where blade 64 stops before reversing direction to the right.

In one embodiment, cleaner roller 52 is rotated by the rotation of pick roller 50 and is thus configured to have low rotational torque. The low rotational torque of cleaner roller 52 configures it to be easily and conveniently moved by the motor that drives pick roller 50. For example, where pick roller 50 is rotated with a first torque by its motor, cleaning roller 52 is movable through the rotation of pick roller 50 with approximately 5 percent of the first torque. Thus, cleaner roller 52 is easy to rotate.

Although specific embodiments have been illustrated and described herein, it will be appreciated by those of ordinary skill in the art that a variety of alternate and/or equivalent implementations may be substituted for the specific embodiments shown and described without departing from the scope of the present invention. Therefore, it is intended that this invention be limited only by the claims and the equivalents thereof.

What is claimed is:

1. A printer media transport system comprising:

a pick roller comprising a pick surface configured to rotate and frictionally direct printable media along a feed path; and a cleaner roller configured to contact the pick roller and rotate as the pick roller rotates, wherein rotation of the cleaner roller is translated to lateral movement of the cleaner roller against the pick surface of the pick roller, wherein the cleaner roller comprises an axle disposed within a drum and a blade coupled to the drum, the axle comprising a surface defining a pattern of grooves, the blade engaged with the pattern of grooves and configured to move laterally along the axle with rotation of the cleaner roller and impart lateral movement to the drum.

2. The printer media transport system of claim 1, wherein the axle comprises a stationary axle and remains fixed relative to rotation of the drum.

3. The printer media transport system of claim 1, wherein the pattern of grooves comprises a helical pattern of bi-lateral reversing grooves.

4. The printer media transport system of claim 1, wherein the drum comprises opposing ends comprising bearings that couple to the axle, the blade coupled to one of the opposing ends of the drum.

5. A printer comprising:

a print carriage for carrying a print cartridge;

an input tray configured to maintain a stack of printable media sheets; and a media transport system configured to select one of the printable media sheets and direct the one of the printable media sheets along a feed path into a print zone accessible by the print cartridge, the media transport system comprising a rotatable pick roller configured to frictionally engage the printable media sheets, and a cleaner roller configured to clean the pick roller, wherein rotation of the pick roller rotates the cleaner roller, and rotation of the cleaner roller imparts side-to-side movement of the cleaner roller relative to the pick roller, wherein the cleaner roller comprises an axle disposed within a drum, and a follower coupled to the drum and engaged with a groove in the axle, wherein the rotation of the cleaner roller rotates the drum and moves the follower within the groove to impart the side-to-side movement of the cleaner roller.

6. The printer of claim 5, wherein the feed path defines a feed direction of the media transport system, and rotation of the pick roller causes the cleaner roller to slide against the pick roller in a direction substantially orthogonal to the feed direction.

7. The printer of claim 5, wherein the cleaner roller is wider than the pick roller by a dimension N and a distance of the side-to-side movement of the cleaner roller comprises approximately N divided by 2.

8. The printer of claim 5, wherein the cleaner roller comprises a cleaning surface configured to scrub bi-laterally against the pick roller in a first direction toward a first end of the pick roller and in a second direction toward a second end of the pick roller away from the first end of the pick roller.

9. A method of cleaning a pick roller employed in a media transport system configured to direct printable media along a feed path, the method comprising:

rotating the pick roller;

rotating a cleaning roller via rotation of the pick roller; and translating rotation of the cleaning roller to lateral movement of the cleaning roller, including sliding the cleaning roller axially relative to and along the pick roller, wherein translating rotation of the cleaning roller to lateral movement of the cleaning roller comprises meshing a follower blade coupled to a drum of the cleaning roller with a groove pattern of an axle disposed within the drum, rotating the drum with the rotating of the cleaning roller, and moving the follower blade within the groove pattern with the rotating of the drum.

10. The method of claim 9, wherein sliding the cleaning roller comprises sliding the cleaning roller axially in a first lateral direction relative to the pick roller, and reversing direction and sliding the cleaning roller axially in a second lateral direction relative to the pick roller.

11. The method of claim 10, wherein sliding the cleaning roller comprises sliding the cleaning roller axially in the first lateral direction along an entire width of the pick roller, and reversing direction and sliding the cleaning roller axially in the second lateral direction along the entire width of the pick roller.

12. The method of claim 9, wherein rotating the pick roller comprises rotating the pick roller with a first torque, and rotating the cleaning roller via rotation of the pick roller comprises freely rotating the cleaning roller with approximately 5 percent of the first torque.

13. A printer media transport system comprising:

a pick roller comprising a pick surface configured to rotate and frictionally direct printable media along a feed path; and a cleaner roller configured to contact the pick roller and rotate as the pick roller rotates, the cleaner roller comprising means for translating rotation of the cleaner roller to lateral movement of the cleaner roller against the pick surface of the pick roller, wherein means for translating rotation of the cleaner roller to lateral movement of the cleaner roller comprises an axle disposed within a drum of the cleaner roller, and a follower coupled to the drum and engaged with a pattern of grooves in the axle, wherein rotation of the cleaner roller rotates the drum and moves the follower within the pattern of grooves.

14. The printer media transport system of claim 13, wherein the axle comprises a stationary axle and remains fixed relative to rotation of the drum.

15. The printer media transport system of claim 13, wherein the follower is disposed within the drum.

16. The printer media transport system of claim 13, wherein the pattern of grooves comprises a helical pattern of bi-lateral reversing grooves.

* * * * *